US007726682B2

(12) United States Patent
Stritzl et al.

(10) Patent No.: US 7,726,682 B2
(45) **Date of Patent: *Jun. 1, 2010**

(54) SLIDING BOARD, IN PARTICULAR A SKI

(75) Inventors: Karl Stritzl, Vienna (AT); Robert Pfaller, Vienna (AT)

(73) Assignee: Tyrolia Technology GmbH, Schwechat (AT)

( * ) Notice: Subject to any disclaimer, the term of this patent is extended or adjusted under 35 U.S.C. 154(b) by 0 days.

This patent is subject to a terminal disclaimer.

(21) Appl. No.: 11/075,564

(22) Filed: Mar. 9, 2005

(65) Prior Publication Data

US 2005/0206129 A1 Sep. 22, 2005

(30) Foreign Application Priority Data

Mar. 18, 2004 (DE) ..... 20 2004 004 304 U

(51) Int. Cl.
*A63C 5/00* (2006.01)

(52) U.S. Cl. ..... 280/607; 280/601; 280/609

(58) Field of Classification Search ..... 280/610, 280/602, 607, 617, 618, 636, 608, 633, 611, 280/14.22, 14.21
See application file for complete search history.

(56) References Cited

U.S. PATENT DOCUMENTS 3,722,901 A * 3/1973 Koike ..... 280/610
3,958,810 A * 5/1976 Bohm ..... 280/610
5,197,752 A * 3/1993 Engelbert et al. ..... 280/610
5,221,105 A * 6/1993 Mayr et al. ..... 280/633
5,338,051 A * 8/1994 Szafranski et al. ..... 280/607
5,836,604 A * 11/1998 Piegay ..... 280/607
5,863,050 A * 1/1999 Meader et al. ..... 280/14.22
6,641,162 B2 * 11/2003 Allmann et al. ..... 280/607
6,910,706 B2 * 6/2005 Holzer et al. ..... 280/618
7,503,578 B2 * 3/2009 Poellmann ..... 280/607
2003/0102651 A1 * 6/2003 Riepler ..... 280/610
2005/0248127 A1 * 11/2005 Baumgartner et al. ..... 280/607

* cited by examiner

*Primary Examiner*—Hau V Phan
(74) *Attorney, Agent, or Firm*—Flynn, Thiel, Boutell & Tanis, P.C.

(57) ABSTRACT

A sliding board, the outsides of which have a running surface and an upper cup, has a foam core created by foaming during its manufacture, and at least one guide element with lateral profiles for arranging and guiding of a binding element on the upper side of the sliding board. The guide element is connected to the sliding-board body by several anchoring elements. The guide element is a plastic part with formed-on anchoring elements, which plastic part is manufactured in one piece. The guide element is bound into the core by the anchoring elements during foaming of the core and is held therein by the hardened foam.

5 Claims, 2 Drawing Sheets

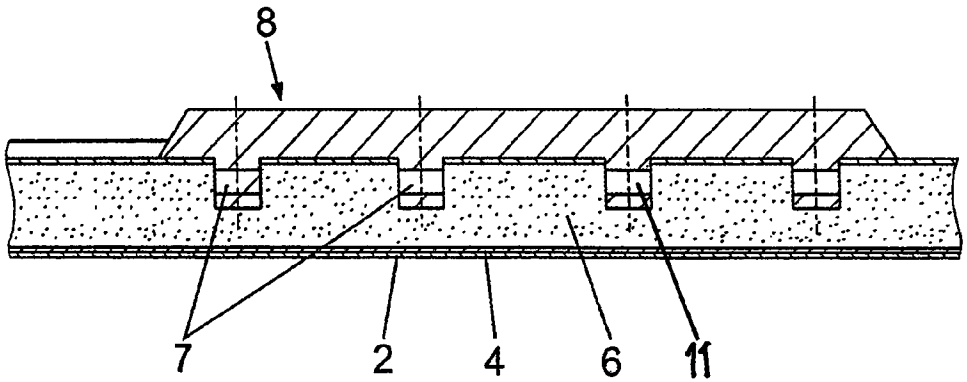
Fig. 2 II - II
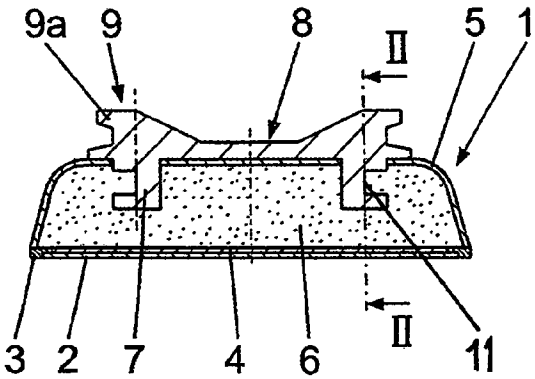
Fig. 1
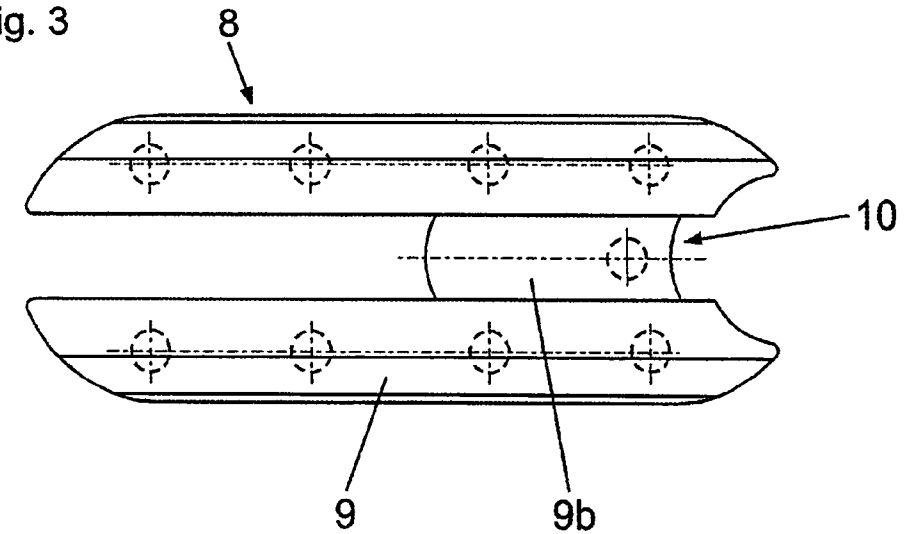
Fig. 3

SLIDING BOARD, IN PARTICULAR A SKI

BACKGROUND OF THE INVENTION

1. Field of the Invention

The invention relates to a sliding board, in particular a ski, the outsides of which have a running surface and an upper cup, and which has a foam core created by foaming during its manufacture and at least one guide element with lateral profiles for arranging and guiding of a binding element on the upper side of the sliding board, which guide element is connected to the sliding-board body by means of several anchoring elements.

2. Description of Related Art

It is common to screw metallic rails onto the upper side of finished skis in order to be able to arrange ski-binding parts, for example a front and heel jaw. These rails usually have lateral profiles so that, for example, a base or support plate of the ski-binding part can be moved onto the rail and can be fixed in a desired position by means of a suitable locking mechanism. It is complicated and expensive to fasten the rails on the upper side of the ski.

The basic purpose of the invention is to find help here and to eliminate the subsequent mounting of rails and the like.

BRIEF SUMMARY OF THE INVENTION

The set purpose is attained inventively by the guide element being a plastic part with formed-on anchoring elements, which plastic part is manufactured in one piece, and by means of which anchoring elements the guide element is bound during foaming of the core into same and is held by the hardened foam.

Thus the metallic rail is in the invention replaced with a plastic part with formed-on anchoring elements, which plastic part is bound or integrated already during the manufacture of the sliding board into same. The finished sliding board has therefore already the "rail", and a subsequent fastening is eliminated.

The sliding board is particularly designed in such a manner that it has a plate-shaped center part between the two profiles. The two profiles can thereby project, in particular on both sides, beyond the center part in longitudinal direction of the sliding board. The guide element, which is designed in one piece, can in this manner be designed with a low weight and yet sufficiently stable for handling without any problems during the manufacture of the ski. In order to save yet further weight, the center part can be provided with at least one recess.

The connection of the guide element to the sliding board or the ski can be further improved by the measure of forming on the underside of the center part at least one anchoring element, which is bound into the foam material of the core.

It is also advantageous in this connection that the anchoring elements have notches, grooves or the like so that their contact surface with the foam material of the core is enlarged.

BRIEF DESCRIPTION OF THE DRAWINGS

Further characteristics, advantages and details of the invention will now be described in greater detail in connection with the drawings, which schematically illustrate several exemplary embodiments of the invention and in which:

FIG. 1 is a cross-sectional view of a ski with one embodiment of the invention, FIG. 2 is a longitudinal cross-sectional view of the ski of FIG. 1 along the cross-sectional plane indicated along the line II-II, FIG. 3 is a top view of the guide element illustrated in FIGS. 1 and 2.

DETAILED DESCRIPTION OF THE INVENTION

Figure 4:
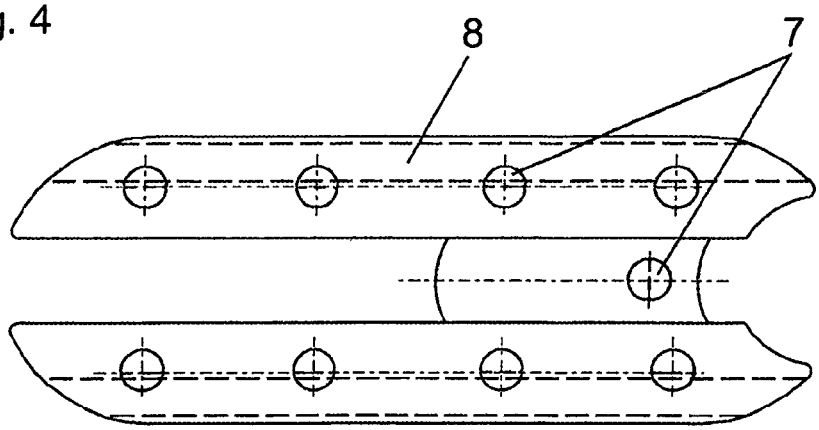
FIG. 4 is a bottom view of the guide element illustrated in FIGS. 1 and 2, FIGS. 5 and 6 are top views of further embodiments of guide elements.

FIG. 1 schematically illustrates a cross section of one embodiment of a ski, which has a running surface 2, steel edges 3, a lower belt 4, an upper cup 5 and a foamed core 6. These components can be designed and manufactured in a conventional manner. The upper cup 5, which is illustrated in one layer, can also be designed with two or several layers, whereby further layers can be inserted below the upper cup 5. The upper cup 5 is a cup-shaped, preformed and premanufactured component.

Anchoring elements 7 of a guide element 8 are bound into the foam material of the core 6 during the manufacture of the ski 1 during the foaming and house-hardening operation of the foam material in order to form the core 6. The guide element 8 is a one-piece plastic part preferably manufactured by injection molding. Profiles 9 forming the anchoring elements 7 and rail-like guideways are formed on the guide element 8. The profiles 9, which extend parallel to one another, as this is shown, for example, in FIG. 1, have each a profile bar 9*a* extending in longitudinal direction and on the outside so that a base plate or support plate for a ski-binding part or a ski-binding part itself can be moved onto and can be slidingly movably guided on the guide element 8 and is locked against a vertical lifting off. The base plate, support plate or the ski-binding part can be fixed and positioned relative to the ski by means of a locking mechanism not illustrated.

A plate-shaped center part 9*b* is provided between the two profiles 9, which center part is provided over a portion, in particular at least one third, of the length of the two profiles 9 in the embodiment illustrated in FIGS. 1 to 4 so that the profiles 9 project on both sides beyond the center part 9*b* and form a pair of longer and a pair of shorter forks. The recess 10 formed between the shorter forks of the two profiles 9 can be provided in order to receive a section of a further plate-shaped component or the like following the guide element 8. A row of anchoring element 7 is formed along each profile on the underside of the guide element 8. FIG. 4 shows that an anchoring element 7 is also formed on the underside of the center part 9*b*. The anchoring elements 7 provided on the underside of the profile are designed as cylindrical pegs in the illustrated embodiment, which pegs have, for example, each one notch 11 on their outer areas. The anchoring element 7 provided on the center part 9*b* has on its side facing the recess 10 such a notch 11. The notches 11 guarantee a solid anchoring of the anchoring elements 7 in the foam material of the core 6.

Holes are created in the premanufactured and preformed upper cup 5, the arrangement and size of which holes corresponds with the size and arrangement of the anchoring elements 7 on the guide element 8. Two guide elements 8 are thereby bound in the longitudinal direction of the ski at a corresponding distance from one another during the manufacture of the ski on which two ski-binding parts, a front jaw and a heel jaw, are supposed to be mounted.

The guide element 8 is during the manufacture of the ski 1 positioned on the upper side of the upper cup 5 by placing the anchoring elements 7 through the holes in the upper cup 5. The positioned and correspondingly assembled further components of the ski 1 are moved into a mold, which is closed. The inside of the ski is subsequently filled with plastic foam, which hardens with the addition of heat and thus connects the individual ski components with one another and with the foam material of the forming core 6. The finished ski is removed from the mold and is suitably finished.

Figure 5:
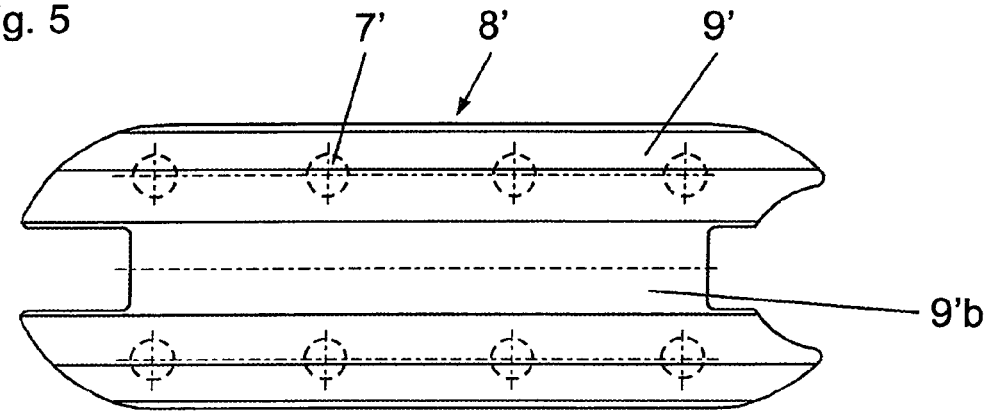

FIG. 5 illustrates an embodiment of a guide element 8', which is designed plate-shaped in its entirety. The center part 9'*b* extends therefore in this embodiment almost over the entire length of the guide element 8'. Anchoring elements 7' are formed on the underside of the profile 9'. Anchoring elements can also be formed in the area of the center part 9'*b* in this embodiment.

Figure 6:
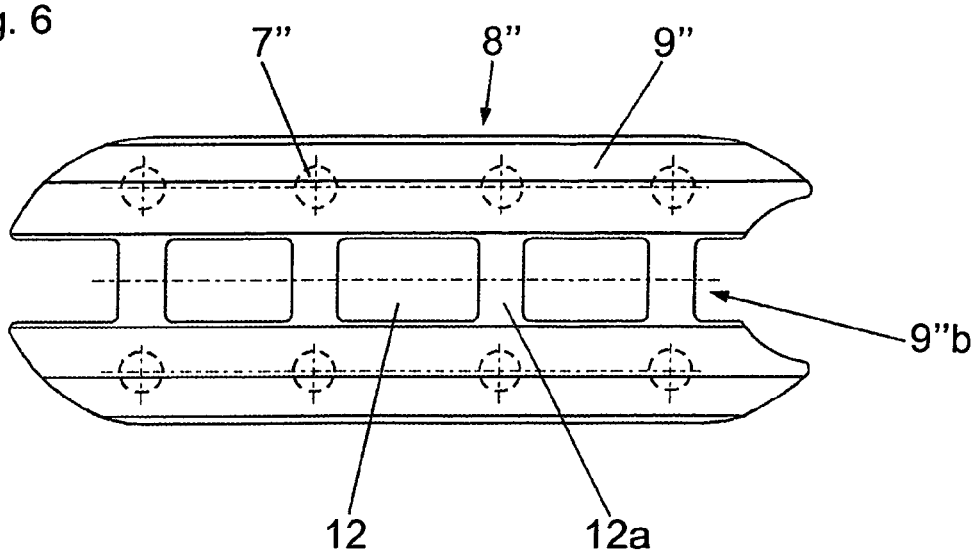

The embodiment illustrated in FIG. 6 differs from the one according to FIG. 5 in that the guide element 8" has a center part 9"*b*, which has three recesses 12 extending in longitudinal direction of the guide element 8". Connecting webs 12*a* are provided between the recesses 12.

The invention is not limited to the illustrated and described embodiments. The anchoring elements can also be designed in a different manner so that they remain securely fixed in the hardened foam. Thus it is possible that they are provided instead of with notches with grooves, holes and the like or they can be designed threadlike. Also a design is possible, in which parts, like pins, small plates or the like, are fastened on the anchoring elements after the positioning of the guide element on the upper cup so that the surfaces covered and enveloped by the foam are enlarged in this manner.

What is claimed is:

1. An elongate sliding board having a lower part and an upper part joined together along lateral edges thereof and a foam core disposed between said upper and lower parts, said upper part having an upwardly facing surface through which at least one aperture extends, a guide element configured for mounting binding elements closely to said upwardly facing surface, said guide element comprising two lateral profiles running in the longitudinal direction of said sliding board for arranging and guiding a binding element on said upper part of said sliding board, and a center part connected to and extending transversely between said lateral profiles, said center part having a longitudinal length less than a longitudinal length of each of said profiles such that adjacent terminal ends of the respective said profiles extend in the longitudinal direction beyond at least one terminal edge of said center part oriented transversely relative to the longitudinal direction, said guide element being integrally formed with at least one anchoring element that is formed to conform to said aperture in said upper part of said sliding board, said anchoring element passing through said upper part and into said foam core, said foam core comprising a heat-hardened foam material that directly encases said anchoring element to secure said guide element to said upwardly-facing surface of said sliding board.

2. The sliding board according to claim 1, wherein said guide element is in uniform contact with said upwardly facing surface.

3. An elongate sliding board comprising:

a lower part defining a downwardly facing surface configured for engagement with a snow-covered surface;

an upper part defining an upwardly-facing surface and being joined to said lower part along respective adjacent lateral edges of said upper and lower parts, said upper part being spaced from said lower part such that said upper and lower parts together define a cavity therebetween, said upper part defining a plurality of apertures therein which open into and communicate with said cavity;

a guide element supported on said upwardly-facing surface of said upper part and including a pair of substantially parallel and rail-shaped profiles extending in a longitudinal direction of said board and being configured for engaging a ski binding, and a plate-shaped center part oriented transversely to the longitudinal direction of said board and interconnecting said profiles to one another, said center part having longitudinally-spaced terminal end edges and a longitudinal length defined between said terminal end edges which is less than longitudinal lengths of the respective said profiles, said profiles having respective pairs of adjacent terminal ends, said pairs of adjacent terminal ends being spaced longitudinally from one another and disposed adjacent the respective said terminal end edges of said center part, each said pair of terminal ends extending in the longitudinal direction of said board beyond the adjacent said terminal end edge of said center part to define respective forked configurations adjacent said terminal end edges of said center part on opposite sides thereof;

a plurality of substantially cylindrically-shaped anchoring elements mounted on respective lower surfaces of each of said profiles, each said anchoring element extending through a corresponding one of said apertures of said upper part and into said cavity; and a foam core disposed within said cavity, said foam core comprising a heat-hardened foam material which directly and completely encases each of said anchoring elements to secure said guide element to said upper surface of said upper part.

4. The sliding board according to claim 3, wherein each said anchoring element defines a laterally-opening notch therein in which said heat-hardened foam material is disposed.

5. The sliding board according to claim 3, wherein said terminal ends of one of said pairs of terminal ends of said profiles extend a further distance in the longitudinal direction beyond the adjacent said terminal end edge of said center part than a distance said terminal ends of the other of said pairs of terminal ends of said profiles extend in the longitudinal direction beyond the adjacent said terminal end edge of said center part.

* * * * *